US005677987A

United States Patent [19]

Seki et al.

[11] Patent Number: 5,677,987

[45] Date of Patent: Oct. 14, 1997

[54] FEEDBACK DETECTOR AND SUPPRESSOR

[75] Inventors: Nobuyuki Seki; Kazuhiro Onizuka, both of Yokohama; Akihisa Kawamura, Hirakata, all of Japan

[73] Assignee: Matsushita Electric Industrial Co., Ltd., Osaka, Japan

[21] Appl. No.: 276,617

[22] Filed: Jul. 18, 1994

[30] Foreign Application Priority Data

Nov. 19, 1993 [JP] Japan ..... 5-290867

[51] Int. Cl.[6] ..... G10L 3/02; G10L 9/00; H04R 27/00; H04B 15/00

[52] U.S. Cl. ..... 395/2.35; 395/2.34; 381/93; 381/83

[58] Field of Search ..... 395/2.35, 2.34, 395/2.36, 2.37, 2.42; 381/71, 93, 94, 83, 96, 68.2, 68.4

[56] References Cited

U.S. PATENT DOCUMENTS

| | | | |
|---|---|---|---|
| 4,079,199 | 3/1978 | Patronis, Jr. | 179/1 |
| 4,091,236 | 5/1978 | Chen | 179/1 |
| 4,165,445 | 8/1979 | Browsow | 179/1 |
| 4,382,398 | 5/1983 | O'Neill | 179/1 |
| 4,602,337 | 7/1986 | Cox | 364/480 |
| 4,658,426 | 4/1987 | Chabries et al. | 381/94 |
| 4,817,160 | 3/1989 | De Koning et al. | 381/83 |
| 5,046,101 | 9/1991 | Lovejoy | 381/57 |
| 5,091,952 | 2/1992 | Williamson et al. | 381/68.2 |
| 5,245,665 | 9/1993 | Lewis et al. | 381/83 |
| 5,442,712 | 8/1995 | Kawamura et al. | 381/83 |

FOREIGN PATENT DOCUMENTS

| | | | |
|---|---|---|---|
| 63-1296 A | 1/1988 | Japan | 381/93 |
| 63-15597 A | 1/1988 | Japan | 381/93 |
| 3-237899A | 10/1991 | Japan | 381/93 |

*Primary Examiner*—Allen R. MacDonald
*Assistant Examiner*—Patrick N. Edouard
*Attorney, Agent, or Firm*—Spencer & Frank

[57] ABSTRACT

An A/D converter converts an analog signal to a digital signal. A plurality of cascade-connected notch filters include a first notch filter which is connected to the output of the A/D converter. A D/A converter is connected to the output of the last stage notch filter for converting a digital signal to an analog signal. The output of the last stage notch filter is connected to the input of a fast Fourier transform unit for analyzing the frequency. Analysis results of the fast Fourier transform unit are supplied to a detector. A coefficient having the same center frequency as that of a peak frequency outputted from the detector is selected from a coefficient memory and it is transferred to a second coefficient memory. Thus, the frequencies of the notch filters are set to eliminate howling.

12 Claims, 13 Drawing Sheets

FEEDBACK DETECTOR AND SUPPRESSOR

BACKGROUND OF THE INVENTION

1. Field of the Invention

The present invention relates to a feedback detector and suppressor, and more particularly to an apparatus for controlling howling generated by the feedback of sound from an audio output such as a speaker to a microphone in audio equipment, particularly in a system for making announcements.

2. Description of the Related Art

In a prior art howling suppression apparatus which uses notch filters, as shown in FIG. 1, an input terminal 101 is connected to a microphone 120 through a level control means 122 and a microphone amplifier 121. An A/D converter 102 converts an analog signal applied to the input terminal 101 to a digital signal. A group of notch filters 103 comprises m cascade-connected notch filters $\mathbf{103}_1$~$\mathbf{103}_m$. The howling suppression apparatus is provided with a group of coefficient memories 104 comprising m coefficient memories $\mathbf{104}_1$~$\mathbf{104}_m$. One coefficient memory is connected to one notch filter, and the coefficients are transferred from the coefficient memories $\mathbf{104}_1$~$\mathbf{104}_m$ to the notch filters $\mathbf{103}_1$~$\mathbf{103}_m$ under the control of coefficient selection means 109 so that the notch filters $\mathbf{103}_1$~$\mathbf{103}_m$ are set to the frequencies to eliminate the howling. A D/A converter 105 converts the digital signal outputted from the last notch filter $\mathbf{103}_m$ of the group of notch filters 103 to an analog signal and supplies it to an output terminal 106. The signal from the output terminal 106 is usually reproduced by a speaker 132 through a power amplifier 131.

On the other hand, the output signal of the A/D converter 102 is supplied to background noise measurement means 110 and fast Fourier transform 107, which is a frequency analysis means. The analyzed result of the fast Fourier transform 107 is supplied to peak detection means 108 and an output signal therefrom is supplied to the coefficient selection means 109, which manages the coefficient transfer from the coefficient memory 111 to the coefficient memories $\mathbf{104}_1$~$\mathbf{104}_m$ connected to the notch filters $\mathbf{103}_1$~$\mathbf{103}_m$.

The operation of the prior art apparatus will now be explained. The input signal level is first measured by the background noise measurement means 110 under non-howling condition. The fast Fourier transform 107 always performs the frequency analysis. The peak of the frequency spectrum is detected by the peak detection means 108 and the peak frequency is held by the peak detection means 108. When a loop gain which causes the howling is raised by the level control means 122, the howling takes place. When it takes place, the background noise measurement means 110 detects a noise of a larger level than that of the previous noise. This rise of level is determined as the howling and the howling detection result is transmitted to the coefficient selection means 109. In response to the howling detection result, the coefficient selection means 109 transfers a coefficient for the first notch filter $\mathbf{103}_1$ from the coefficient memory 111 to the coefficient memory $\mathbf{104}_1$ connected to the first notch filter $\mathbf{103}_1$ such that it has a center frequency corresponding to the peak frequency at that moment. Since the notch filter coefficient which causes the same center frequency as that of the howling frequency is transferred to the coefficient memory $\mathbf{104}_1$, the frequency setting of the first notch filter $\mathbf{103}_1$ is effected and the howling frequency is eliminated.

In this manner, the prior art howling suppression apparatus suppresses howling.

However, the prior art howling suppression apparatus has the following problems:

(1) Since the howling is detected by the rise of the level, the occurrence of howling may be erroneously detected when the level rises due to input of the sound of footsteps or human sounds.

(2) Since the howling input signal is received at the input terminal, erroneous detection may occur when a signal having a peak at a predetermined frequency such as hum is included in the input signal.

(3) Since the generation of the howling depends on the external gain rise means (level control means 122), the operation to generate the howling is not easy.

(4) Since the generation of the howling depends on the external gain rise means, the increment of the acoustic gain after the suppression of the howling is not known.

SUMMARY OF THE INVENTION

It is an object of the present invention to provide an improved feedback detector and suppressor which can stably detect howling under a relatively large background noise and suppress it.

In order to achieve the above object, the feedback detector and suppressor of the present invention, in a first aspect, comprises; an A/D converter for converting an analog signal to a digital signal; a plurality of cascade-connected notch filters including a first notch filter connected to an output of said A/D converter and a last notch filter connected in the last stage; a D/A converter connected to an output of said last notch filter for converting a digital signal to an analog signal; frequency analysis means connected to an output of said last notch filter for analyzing a frequency characteristic of a signal supplied from said last notch filter; and detection means connected to an output of said frequency analysis means for producing peak frequency values for setting center frequencies of said notch filters based on analysis results by said frequency analysis means.

In a second aspect of the feedback detector and suppressor of the present invention, said detection means of the first aspect includes means for determining a weighted difference between a maximum of the analysis results of said frequency analysis means and a mean value or a sum of the analysis results and means for outputting the peak frequency value when the determined weighted difference exceeds a predetermined value.

In a third aspect of the feedback detector and suppressor of the present invention, said detection means of the first aspect includes means for determining a weighted difference between a maximum of the analysis results of said frequency analysis means and a mean value or a sum of a plurality of analysis results of all of the analysis results and means for outputting the peak frequency value when the determined weighted difference exceeds a predetermined value.

In a fourth aspect of the feedback detector and suppressor of the present invention, said detection means of the second aspect further includes means for determining a mean value of remaining analysis results after the elimination of a plurality of largest analysis results of all of the analysis results as the mean value or the sum of the analysis results supplied from said frequency analysis means.

In a fifth aspect of the feedback detector and suppressor of the present invention, means connected to the output of said detection means of the second aspect is further provided for outputting the peak frequency value only when the peak frequency value outputted by said detection means is continuously same a plurality of time.

In a sixth aspect of the feedback detector and suppressor of the present invention, means connected to the output of said detection means of the third aspect is further provided for outputting the peak frequency value only when the peak frequency value outputted by said detection means is continuously the same a plurality of time.

In a seventh aspect of the feedback detector and suppressor of the present invention, a time-serially varying sound level control means is further provided in the first aspect for controlling the gain between the input and the output.

In an eighth aspect of the feedback detector and suppressor of the present invention, a peak of the gain imparted to said sound level control means is displayed in the seventh aspect.

In a ninth aspect of the feedback detector and suppressor of the present invention, a compressor/limiter connected preceding or succeeding to said notch filters is further provided in the first aspect for limiting the amplitude.

In accordance with the first aspect of the present invention, since the signal to detect the howling is derived from the output of the group of notch filters which eliminate the howling, even if an input signal having a hum component having a peak at a predetermined frequency is applied, the hum can be eliminated by the group of notch filters. As a result, erroneous detection of the howling due to the hum is unlikely to occur.

In accordance with the second aspect of the present invention, since the weighted difference of the mean value (or the sum) and the peak value of the analysis results is used to detect the howling, erroneous detection is unlikely to occur even if the background noise level changes.

In accordance with the third aspect of the present invention, when the weighted difference between the maximum value of the analysis results and the mean value (or the sum) of any plurality of ones of the analysis results exceeds the preset value, the occurrence of the howling is detected. Accordingly, the amount of operation is less than that of the second aspect and the howling can be detected faster.

In accordance with the fourth aspect of the present invention, when the mean value (or the sum) of the analysis results is calculated, a plurality of the largest ones of the analysis results are eliminated. Accordingly, howling may be detected while it has not fully grown and remains at a low level, and the time required to detect the howling is shortened.

In accordance with the fifth aspect of the present invention, when a peak frequency corresponding to the howling frequency continuously appears a plurality of times, the occurrence of howling is detected. Accordingly, a signal having a frequency peak in a relatively short period such as the sound of footsteps is unlikely to be detected as howling, and a signal with a varying pitch (peak frequency), such as the sound of a whistle or a musical instrument, is also unlikely to be detected as howling, and hence erroneous detection is unlikely to be to occur.

In accordance with a sixth aspect of the present invention, when the peak frequency corresponding to a howling frequency continuously appears a plurality of times, the occurrence of howling is detected. Accordingly, the amount of operation is less than that of the fifth aspect and the howling can be detected faster.

In accordance with the seventh aspect of the present invention, a time-serially varied sound level control means is provided to control the gain between the input and the output. Accordingly, control of the occurrence of howling can be managed and the howling can be automatically suppressed by the link of the occurrence of the howling and the detection of the howling, without rapid growth of the howling, and simple operation is attained.

In accordance with the eighth aspect of the present invention, the peak of the gain imparted by the sound level control means is displayed. Accordingly, the howling suppression effect, that is, the rise increment of the acoustic gain by the howling suppression, can be rapidly grasped.

In accordance with the ninth aspect of the present invention, a compressor/limiter for limiting the amplitude is provided in the preceding or succeeding stage of the notch filter. Accordingly, even if the detection of howling fails and the howling grows rapidly, the amplitude is limited by the compressor/limiter to avoid damaging equipment such as the speaker connected to the output of the present apparatus. Further, since the compressor/limiter limits the amplitude without increasing distortion, erroneous detection by the howling detector due to harmonics distortion can be avoided.

DESCRIPTION OF THE PREFERRED EMBODIMENTS

Figure 1:
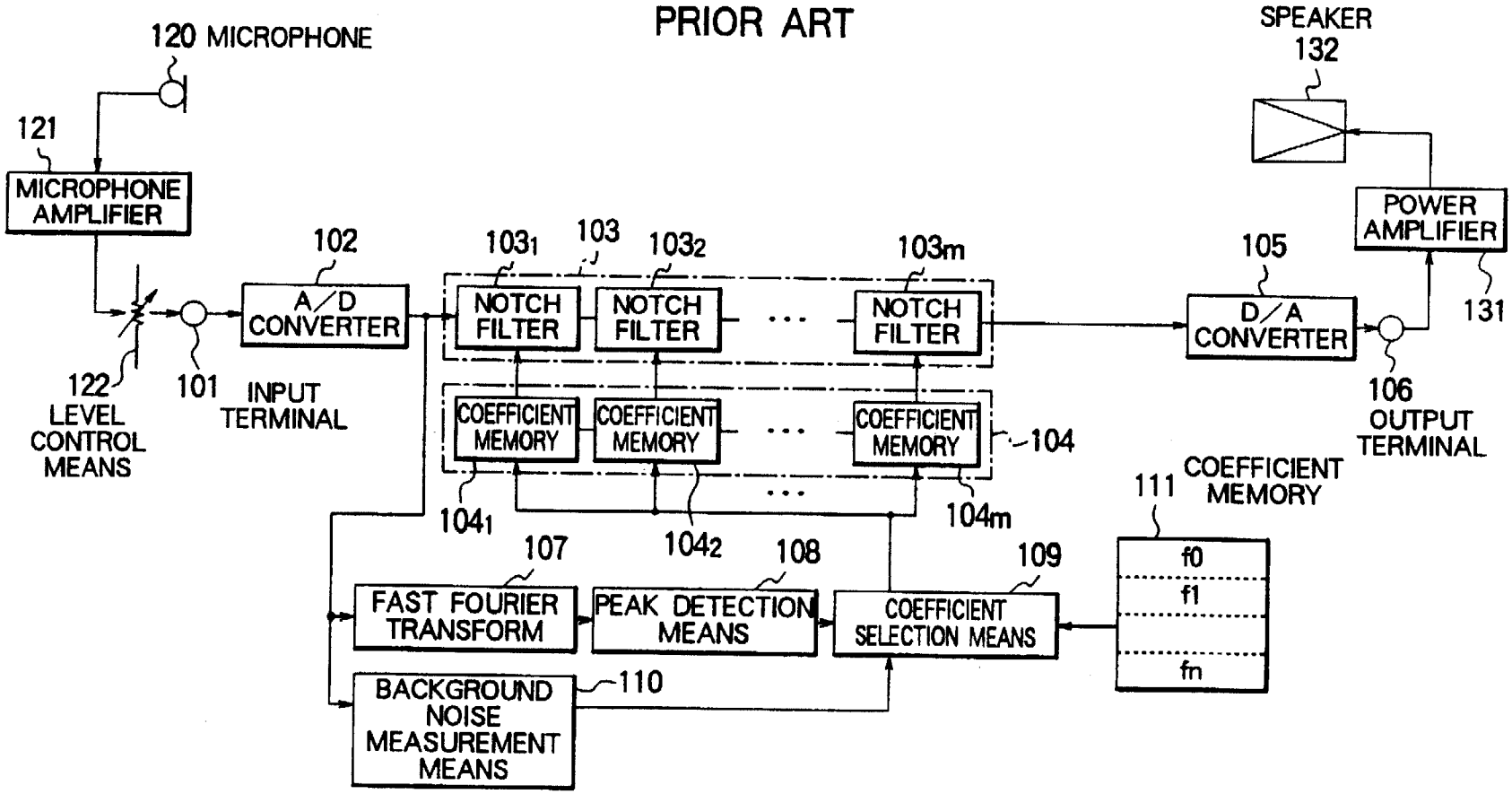
FIG. 1 PRIOR ART
FIG. 1 shows a block diagram of a prior art howling suppressor.
Figure 2:
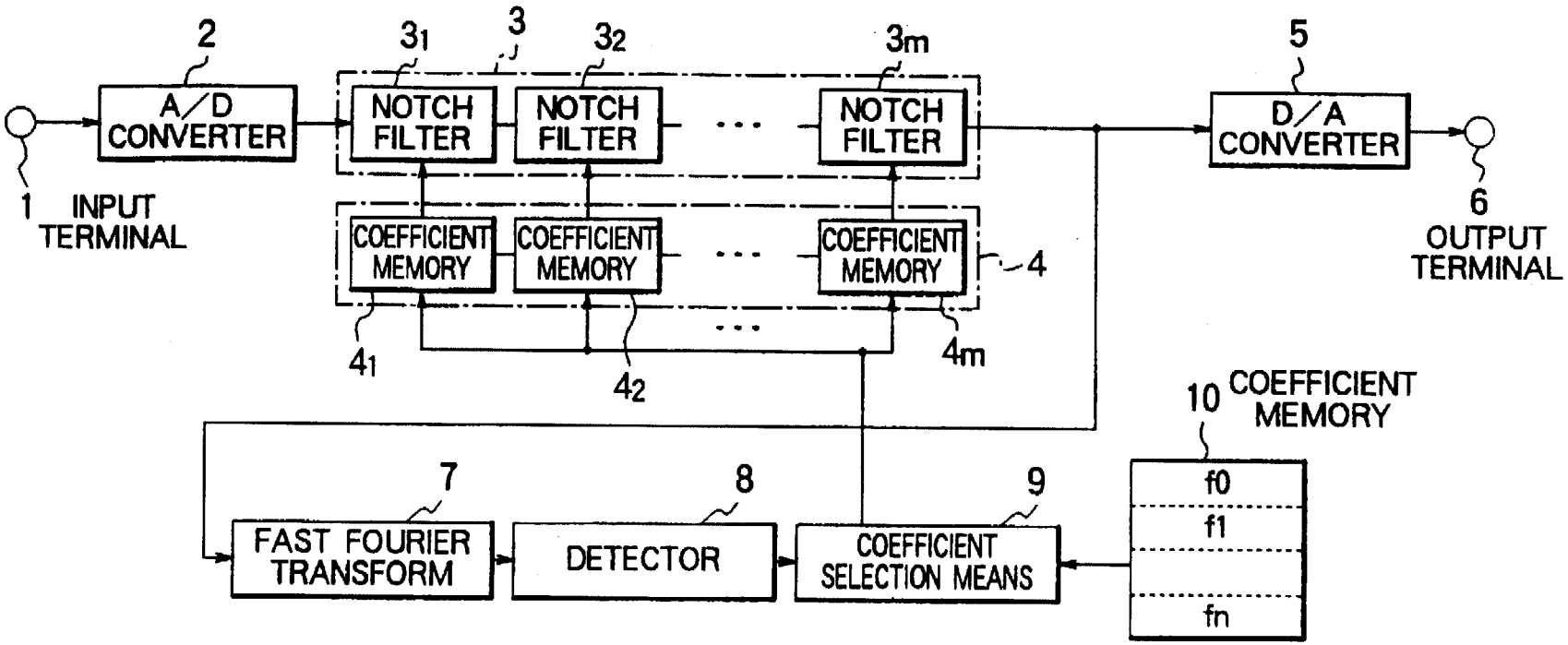
FIG. 2 shows a block diagram of a howling suppressor in accordance with a first embodiment of the present invention.

As shown in FIG. 2, a howling suppressor in accordance with the first embodiment of the present invention comprises an input terminal 1, an A/D converter 2, a group of notch filters 3 including m notch filters $3_1$~$3_m$, a group of coefficient memories 4 including m coefficient memories $4_1$~$4_m$, a D/A converter 5, an output terminal 6, a fast Fourier transform unit 7, a detector 8, coefficient selection means 9 and a coefficient memory 10. The input terminal 1 is connected to an external microphone (not shown) (see FIG. 1). The A/D converter 2 converts an analog signal applied to the input terminal 1 to a digital signal. The m notch filters $3_1$~$3_m$ which form the group of notch filters 3 are cascade-connected and one of the m coefficient memories $4_1$~$4_m$ which form the group of coefficient memories 4 is connected to each of the notch filters. Center frequencies of the notch filters $3_1$~$3_m$ for eliminating the howling are set by the coefficients supplied from the coefficient memories $4_1$~$4_m$ connected to the notch filters $3_1$~$3_m$, respectively. The D/A converter 5 converts the digital signal outputted from the last notch filter $3_m$ of the group of notch filters 3 to an analog signal and supplies it to the output terminal 6. The output signal from the output terminal 6 is reproduced by a speaker (not shown) through a power amplifier (not shown) (see FIG. 1).

The output signal of the last notch filter $3_m$ is also applied to the fast Fourier transform unit 7, which is a frequency analysis means. The analysis result by the fast Fourier transform unit 7 is supplied to the detector 8 and the output signal of the detector 8 is supplied to the coefficient selection means 9, which manages the transfer of the coefficients from the coefficient memory 10 to the coefficient memories $4_1$~$4_m$ connected to the notch filters $3_1$~$3_m$, respectively.

Figure 3:
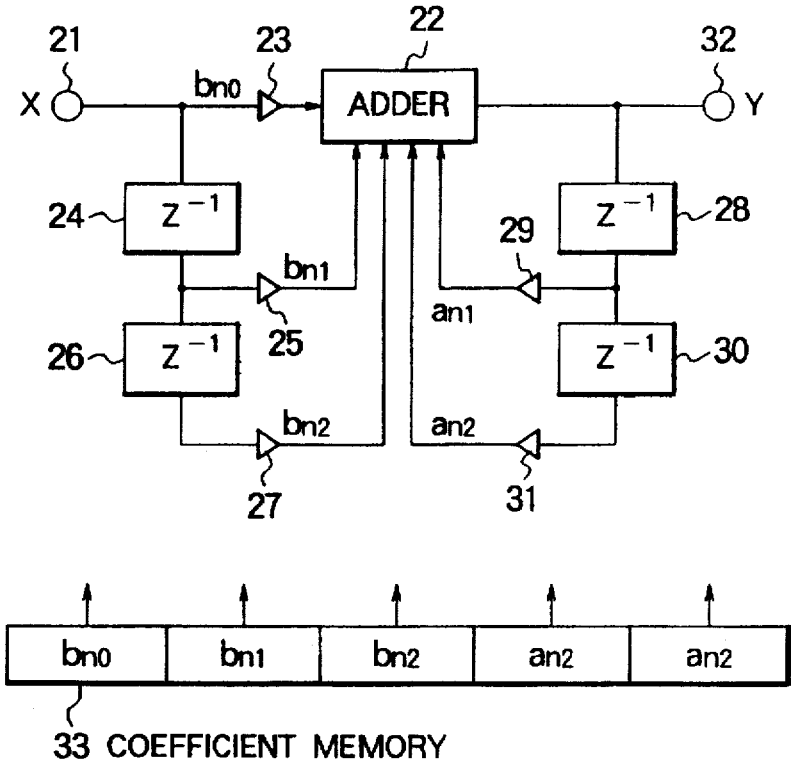
FIG. 3 shows a block diagram of a notch filter in the first embodiment of the present invention.

As shown in FIG. 3, each of the notch filters $3_1$~$3_m$ is configured as a so-called two-dimension digital biquad filter and has a transfer function H(z) given by;

$$H(z)=Y/X=(b_{n0}+b_{n1}Z^{-1}+b_{n2}Z^{-2})/(1-a_{n1}Z^{-1}-a_{n2}Z^{-2})$$

Accordingly, in each of the notch filters $3_1$~$3_m$, a coefficient $b_{n0}$ of a multiplier 23 connected between an input terminal 21 and an adder 22, a coefficient $b_{n1}$ of a multiplier 25 connected between a delay circuit 24 and the adder 22, a coefficient $b_{n2}$ of a multiplier connected between a delay circuit 26 and the adder 22, a coefficient $a_{n1}$ of a multiplier 29 connected between a delay circuit 28 and the adder 22 or a coefficient $a_{n2}$ of a multiplier 31 connected between a delay circuit 30 and the adder 22 is selected as the predetermined coefficient. As a result, a bell shape frequency characteristic having an attenuation peak at the center frequency fm is produced. The output signal of the adder 22 is outputted from an output terminal 32. In the filter shown in FIG. 3, the coefficients $b_{n0}$~$b_{n2}$, $a_{n1}$ and $a_{n2}$ of the multipliers 23, 25, 27, 28 and 30 are supplied from a coefficient memory 33 of the filter, although they may be directly supplied from the coefficient memories $4_1$~$4_m$ of the group of memories 4 shown in FIG. 2 to the multipliers 23, 25, 27, 28 and 30, respectively.

Figure 5:
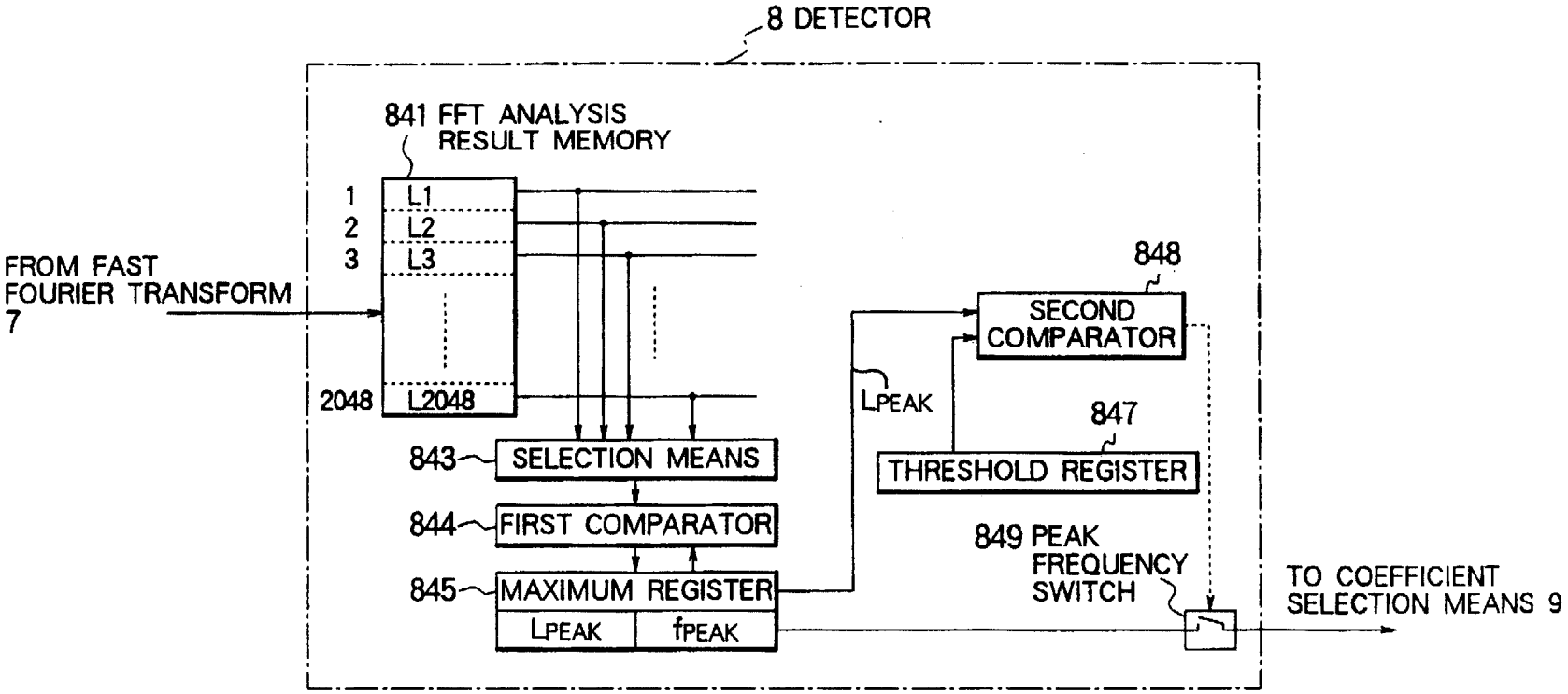
FIG. 5 shows a block diagram of a detector in the first embodiment of the present invention.

As shown in FIG. 5, the detector 8 comprises an FFT analysis result memory 841, selection means 843, a first comparator 844, a maximum register 845, a threshold register 847, a second comparator 848 and a peak frequency switch 849. The FFT analysis result memory 841 stores analysis results $L_1$~$L_{2048}$ sent from the fast Fourier transform unit 7. For example, when the fast Fourier transform 7 conducts a 4096-point fast Fourier transform unit, power values of 2048-point frequency components are stored in the FFT analysis result memory 841. The analysis results $L_1$~$L_{2048}$ stored in the FFT analysis result memory 841 are supplied to the selection means 843. In the selection means 843, the first analysis result $L_1$ is first selected and it is stored in the maximum register 845 as a maximum $L_{PEAK}$. Then, the second analysis result $L_2$ is selected by the selection circuit 843. The selected analysis result $L_2$ is compared by the first comparator 844 with the maximum $L_{PEAK}$ stored in the maximum register 845. For example, when the second analysis result $L_2$ is larger than the maximum $L_{PEAK}$, the second analysis result $L_2$ is stored in the maximum register 845 as a new maximum $L_{PEAK}$ and the frequency number "2" corresponding to the second analysis result $L_2$ is stored in the maximum register 845 as a peak frequency value $f_{PEAK}$. Then, the third analysis result $L_3$ is selected by the selection circuit 843 and a similar operation is repeated. When a similar operation for the last analysis result $L_{2048}$ is completed, the maximum $L_{PEAK}$ indicating the maximum of the analysis results $L_1$~$L_{2048}$ and the peak frequency value $f_{PEAK}$ indicating the frequency number corresponding to the maximum $L_{PEAK}$ are finally stored in the maximum register 845. The maximum $L_{PEAK}$ finally stored in the maximum register 845 is sent to the second comparator 848 and compared with a preset threshold stored in the threshold register 847. If the maximum $L_{PEAK}$ is larger than the threshold, the peak frequency switch 849 is actuated by the second comparator 848 so that the peak frequency value $f_{PEAK}$ finally stored in the maximum register 845 is sent to the coefficient selection means 9 through the peak frequency switch 849.

The operation of the howling suppressor shown in FIG. 2 will now be explained. In an initial condition, the notch filters $3_1$~$3_m$ have their coefficients imparted to exhibit flat frequency characteristics. When an input signal having a howling component is applied to the input terminal 1, the input signal passes through the group of notch filters 3 having the flat frequency characteristic and is applied to the fast Fourier transform unit 7. Since the input signal having the howling component exhibits a peak in its frequency characteristic, the signal applied to the fast Fourier transform unit 7 also has a peak in its frequency characteristic. The fast Fourier transform 7 frequency-analyzes the input signal to determine the frequency spectrum for the input signal (analysis results $L_i$~$L_{2048}$). The analysis results $L_1$~$L_{2048}$ are supplied to the detector 8. The detector 8 conducts the operation described above to detect the presence of the peak on the frequency axis which is a characteristic of the howling. If the peak (maximum $L_{PEAK}$) is larger than the threshold stored in the threshold register 847 (see FIG. 5), the peak frequency value $f_{PEAK}$ corresponding to the peak frequency on the frequency axis is supplied to the coefficient selection means 9 from the detector 8. The coefficient selection means 9 selects a coefficient of the notch filter having the center frequency fm corresponding to the peak frequency from the coefficient memory 10 in accordance with the inputted peak frequency value $f_{PEAK}$. The selected coefficient is transferred to the coefficient memory $4_1$ connected to the first notch filter $3_1$.

Figure 4:
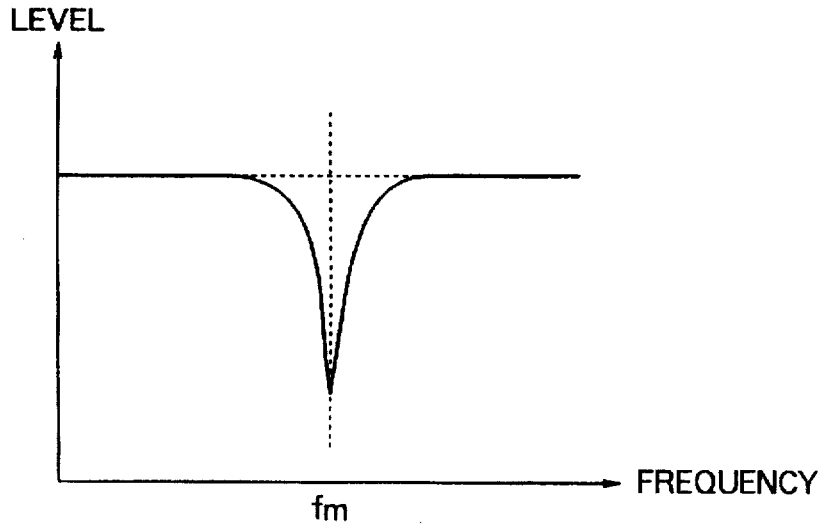
FIG. 4 shows a characteristic of the notch filter in the first embodiment of the present invention.

As a result, the first notch filter $3_1$, configured as a biquad digital filter as shown in FIG. 3, exhibits the frequency characteristic shown in FIG. 4, so that the input signal can pass through the group of notch filters 3 and the howling frequency component of the input signal can be attenuated. If new howling occurs subsequently, the coefficients of the second notch filter $3_2$ to the last notch filter $3_m$ are sequentially set in a similar manner to suppress all howlings.

If an input signal having a hum component with a peak at 50 Hz on the frequency axis is applied to the input terminal 1, a notch filter having an attenuation peak at 50 Hz is established at the first detection of the howling and the hum component is attenuated. Subsequently, the notch filters are set for other howlings than the hum component.

In accordance with the howling suppressor of the first embodiment of the present invention, since the signal to detect the howling is derived from the output of the group of notch filters 3 for eliminating the howling, a hum component can be eliminated by the group of notch filters 3 if an input signal having a hum component with a peak at the predetermined frequency is applied. As a result, erroneous detection of howling caused by the hum is unlikely to of occur.

Figure 6:
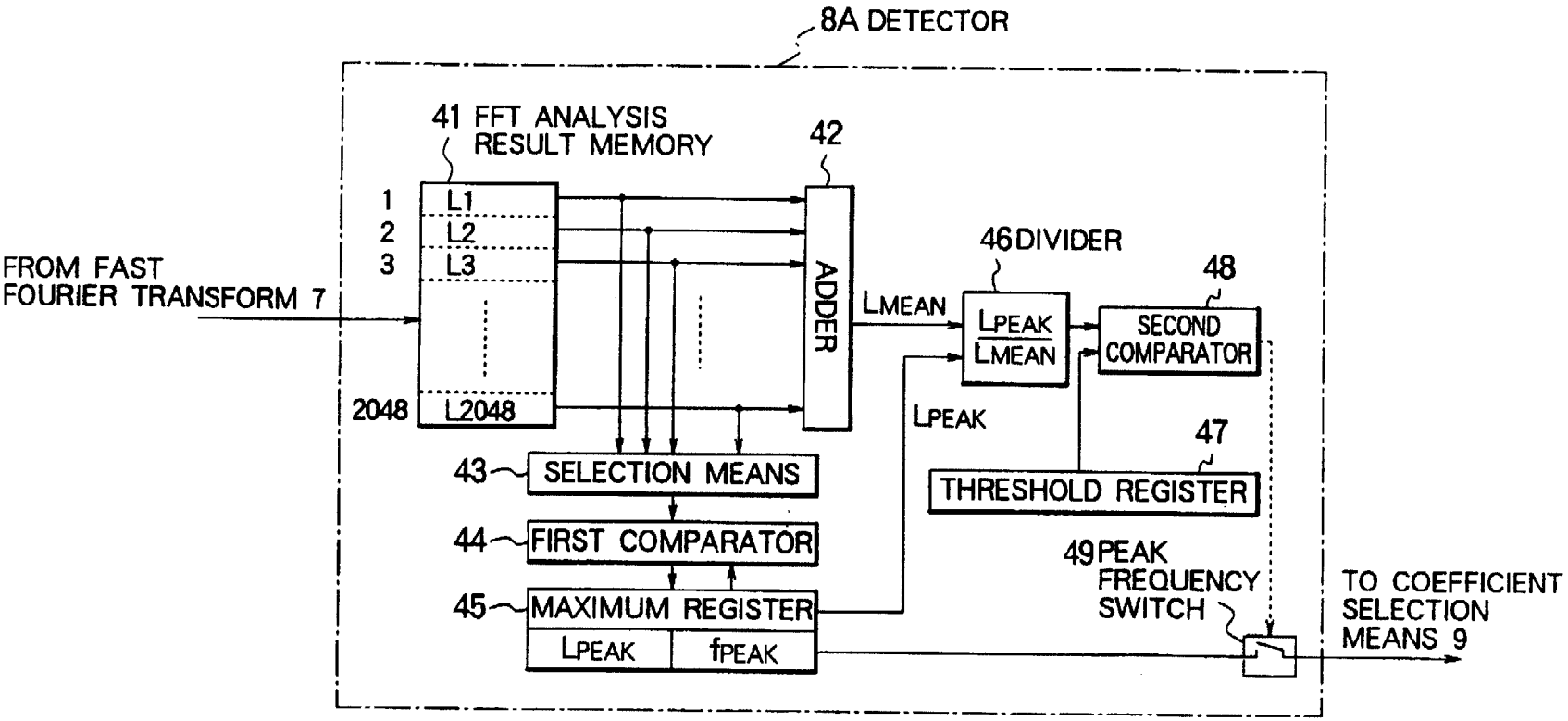
FIG. 6 shows a block diagram of a detector in a second embodiment of the present invention.

FIG. 6 shows a block diagram of a detector in a second embodiment of the present invention. The detector 8A in the present embodiment differs from the detector 8 shown in FIG. 5 in that it comprises an adder 42 for adding all of the analysis results $L_1$~$L_{2048}$ stored in an FFT analysis result memory 41 and a divider 46 for dividing a maximum $L_{PEAK}$ outputted from a maximum register 45 by a sum $L_{MEAN}$ outputted from the adder 42, and a second comparator 48 compares a quotient $L_{PEAK}/L_{MEAN}$ outputted from the divider 46 with a threshold stored in a threshold register 47.

Figure 7:
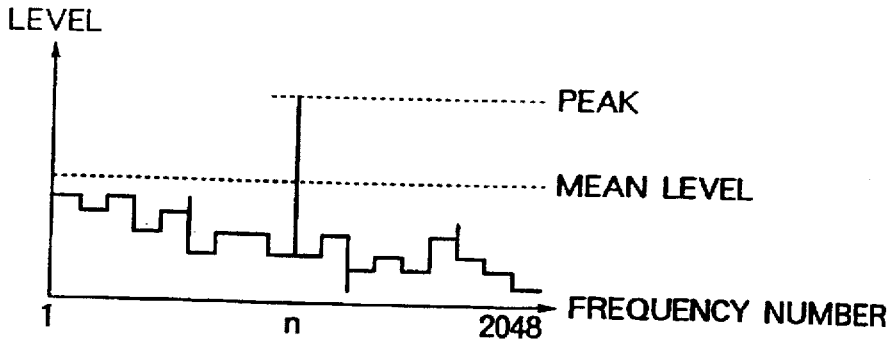
FIG. 7 shows a characteristic chart of a result of a fast Fourier transform when howling occurs in the second embodiment of the present invention.

When howling occurs, the analysis results $L_1$~$L_{2048}$ stored in the FFT analysis result memory 41 may have a level distribution as shown in FIG. 7. Namely, when the howling has fully grown, it exhibits a sufficiently large peak with respect to the background noise. Since the mean value of the analysis results $L_1$~$L_{2048}$ is normally smaller than the peak, a weighted difference between the mean value and the peak can be calculated.

In the detector 8A shown in FIG. 6, the sum $L_{MEAN}$ of the analysis results $L_1$~$L_{2048}$ at 2048 points is used instead of the mean value. Accordingly, the sum $L_{MEAN}$ is at least 2048 times as large as any one of the analysis results $L_1$~$L_{2048}$, but it does not affect to the discrimination of the background level and the peak if the threshold weighted by a factor of 2048 is stored in the threshold register 47.

By using the detector 8A of the second embodiment, the howling is detected by using the weighted difference between the mean value (or the sum) of the analysis results and the peak so that erroneous detection is unlikely to occur even if the background noise level changes.

Figure 8:
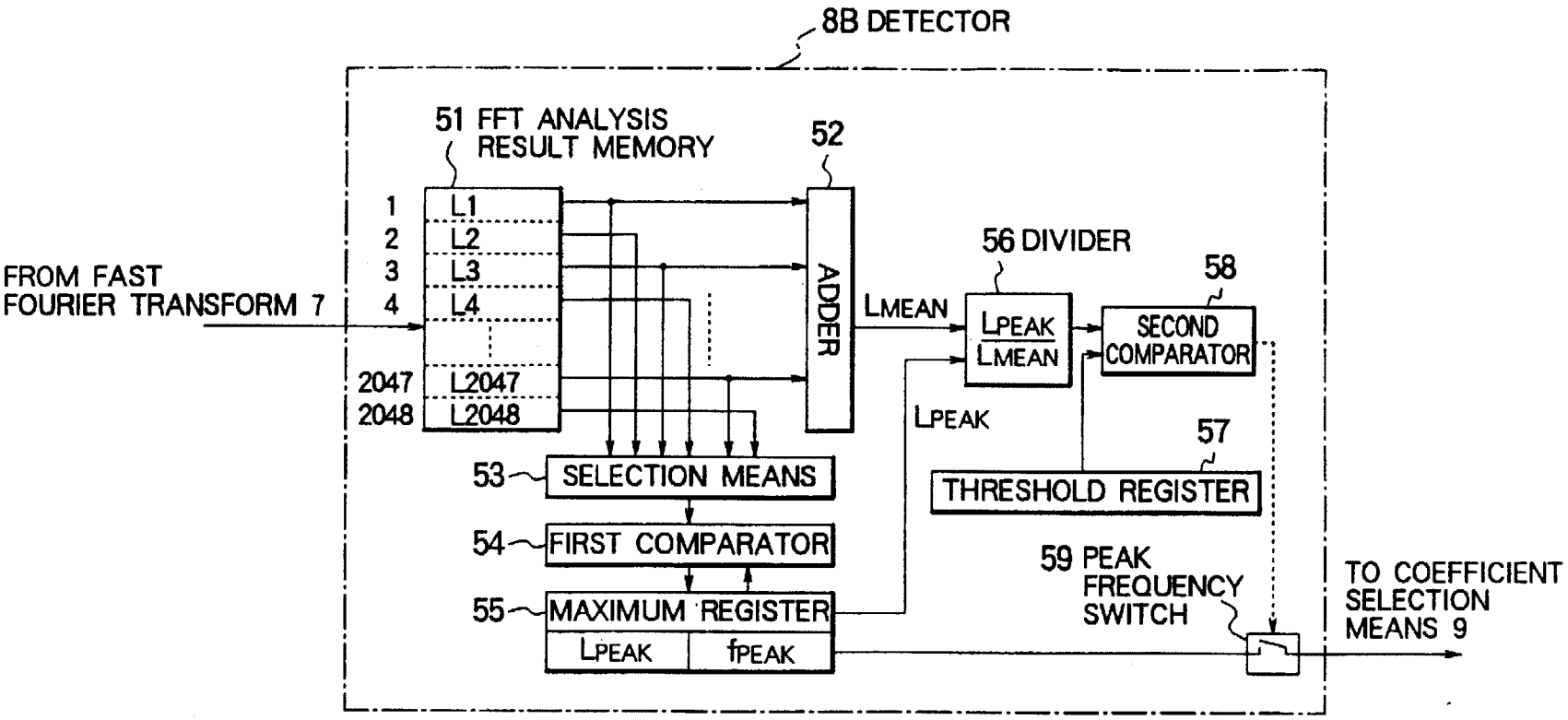
FIG. 8 shows a block diagram of a detector in a third embodiment of the present invention.

FIG. 8 shows a block diagram of a detector in a third embodiment of the present invention. The detector 8B in the present embodiment has the same configuration as that of the detector 8A shown in FIG. 6 but it differs in that an adder 52 adds only odd numbered analysis results $L_1$, $L_3$, . . . , $L_{2047}$ of analysis results $L_1$~$L_{2048}$ stored in an FFT analysis result memory 51. Normally, the peaks in the howling appear at several points on the frequency axis. Accordingly, the addition of the analysis results $L_1$~$L_{2048}$ may be partially omitted without substantial affect to the mean value (or the sum) of the analysis results $L_1$~$L_{2048}$.

In the detector 8B in the third embodiment, when the weighted difference between the maximum of the analysis results and the sum or mean value of half of the analysis results exceeds the predetermined threshold, the occurrence of howling is detected. Thus, the amount of operation is less than that of the second embodiment and the howling may be detected faster.

The addition in the adder 52 may be done for even numbered analysis results $L_2$, $L_4$, . . . , $L_{2048}$, or for any plurality of analysis results from among all the analysis results to attain the same effect.

Figure 9:
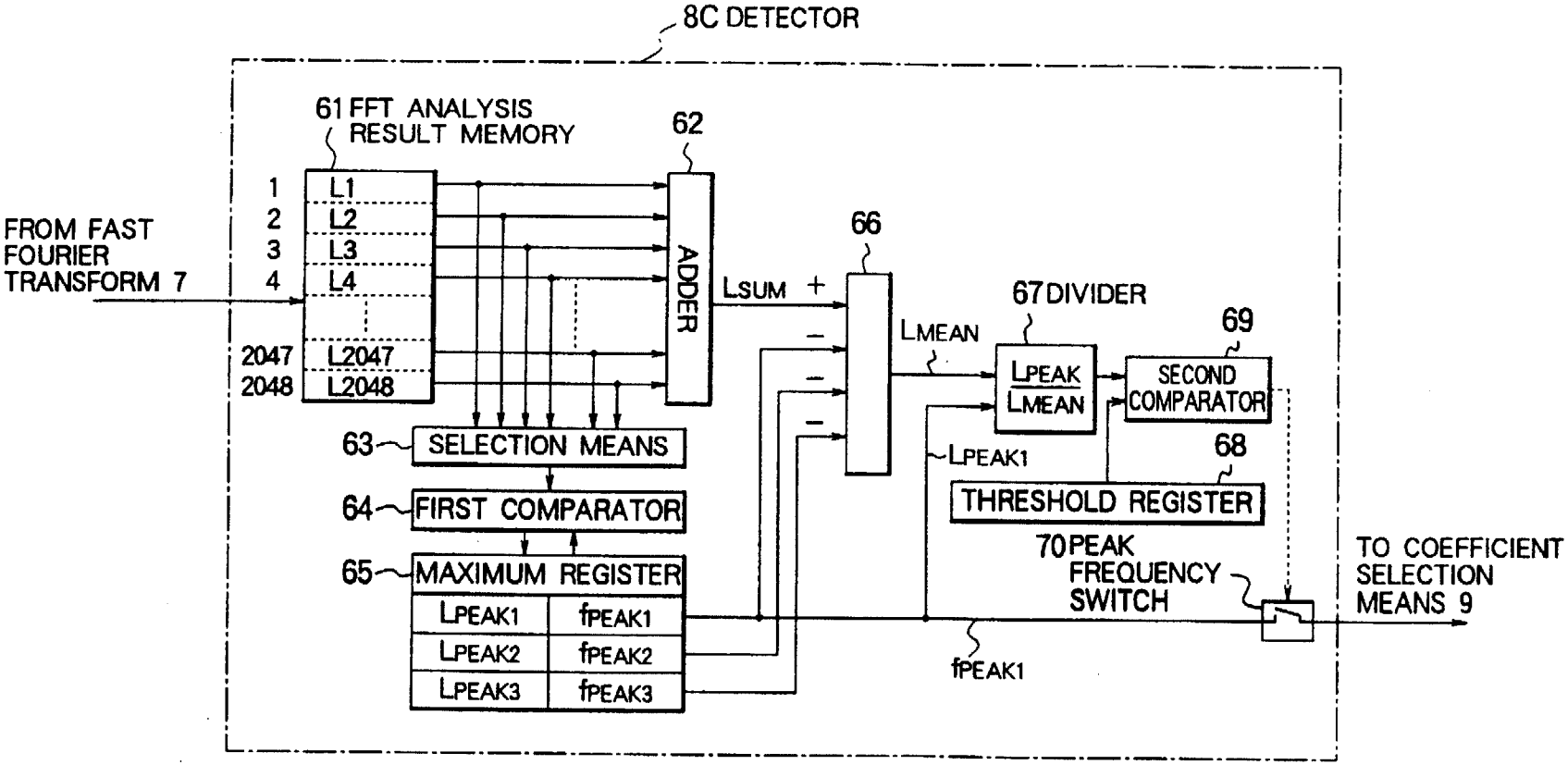
FIG. 9 shows a block diagram of a detector in a fourth embodiment of the present invention.

FIG. 9 shows a block diagram of a detector in a fourth embodiment of the present invention. The detector 8C of the present embodiment differs from the detector 8A shown in FIG. 6 in the following points.

(1) A maximum register 65 stores the largest one (the first maximum $L_{PEAK1}$) of analysis results $L_1$~$L_{2048}$ stored in an FFT analysis result memory 61, the second largest one (the second maximum $L_{PEAK2}$) and the third maximum one (the third maximum $L_{PEAK3}$) as well as the first to third peal frequency values $f_{PEAK1}$~$f_{PEAK3}$ indicating the frequency numbers corresponding to the first to third maximums $L_{PEAK1}$~$L_{PEAK3}$.

(2) A subtractor 66 which subtracts the first to third maximums $L_{PEAK1}$~$L_{PEAK3}$ stored in the maximum register 65 from the sum $L_{SUM}$ of an adder 62 which adds all analysis results $L_1$~$L_{2048}$ stored in the FFT analysis result memory 61 is provided between the adder 62 and a divider 67.

In the detector 8C of the present embodiment, the first to third maximums $L_{PEAK1}$~$L_{PEAK3}$ which include the howling component are subtracted from the sum $L_{SUM}$ in which the howling component has a relatively large weight by the subtractor 66. Thus, the background noise level measurement with the howling component eliminated more precisely is attained. Namely, even if the howling component is relatively small, the output signal from the divider 67 which exceeds the threshold may be derived. The number of the maximums $L_{PEAK}$ subtracted from the sum $L_{SUM}$ by the subtractor 66 may be other than three to attain the same effect.

By using the mean value or sum of the remaining analysis results after the elimination of a plurality of largest analysis results of all the analysis results as the mean value or sum of the analysis results, the howling may be detected while the howling has not fully grown and is at a low level. Thus, the time required to detect the howling can be shortened.

Figure 10:
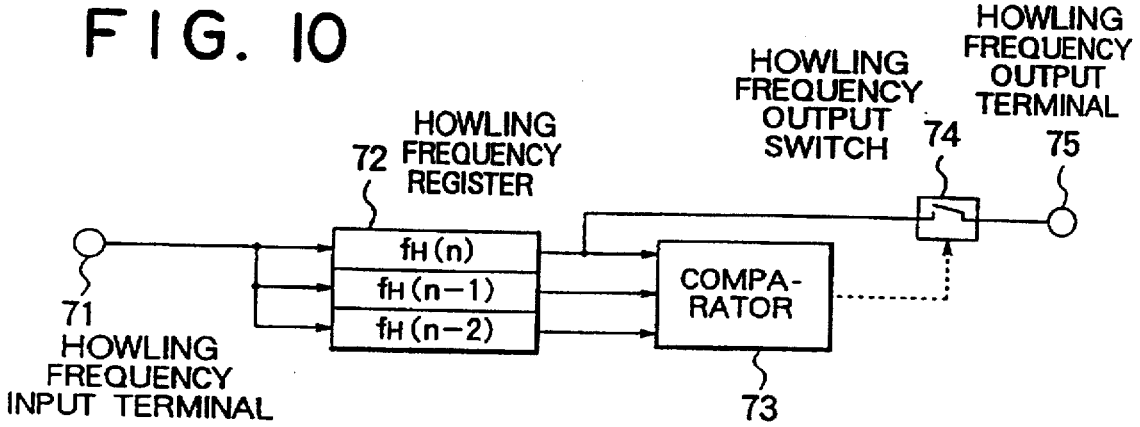
FIG. 10 shows a block diagram of a howling detector attached to a detector in fifth and sixth embodiments of the present invention.

A howling suppressor in a fifth embodiment of the present invention will now be explained. The howling suppressor of the present embodiment has a howling detector shown in FIG. 10, which is connected to the output stage of the peak frequency switch 49 of the detector 8A in the second embodiment shown in FIG. 6. In FIG. 10, numeral 71 denotes an input terminal for receiving the howling frequency, and is connected to a howling frequency register 72. The howling frequency register 72 stores up to two past howling frequencies along with the present howling frequency. The howling frequency register 72 is updated each time howling is detected. Numeral 73 denotes a comparator which turns on a howling frequency output switch 74 when all of the three howling frequencies stored in the howling frequency register 72 match, so that the howling frequency is conveyed to a howling frequency output terminal 75.

Figure 11:
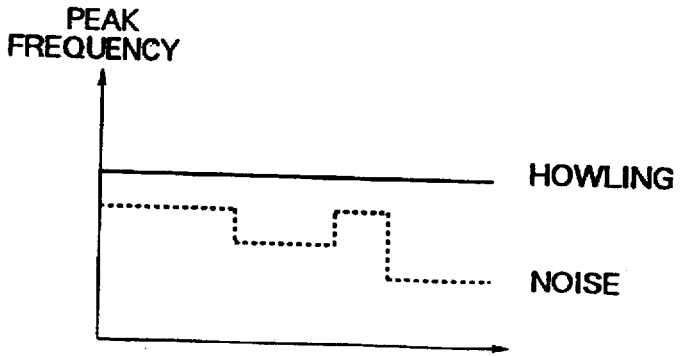
FIG. 11 shows a characteristic chart showing time-serial change of a peak frequency when the howling occurs.

Howling has a property which is stable in time as shown by a solid line in FIG. 11. On the other hand, the human voice and musical instruments have varying frequency values in time as shown by a broken line. Accordingly, if the same frequency continuously appears a plurality of time, the probability of howling is high.

In the howling detector shown in FIG. 10, howling is detected when the peak frequency value corresponding to howling frequency exhibits the same value continuously three times. Thus, erroneous detection of a signal having the peak on a frequency axis in a relatively short period, such as the sound of footsteps or a signal of varying pitch (peak frequency) such as a whistle or the sound of a musical instrument, is avoided and erroneous detection is unlikely to occur. The same effect may be attained when the number of howling frequencies stored in the howling frequency register 73 is other than three.

In a howling suppressor of a sixth embodiment of the present invention, the howling detector shown in FIG. 10 is connected to the output stage of the howling frequency output switch 59 in the third embodiment shown in FIG. 8. In the howling suppressor of the present embodiment, by the provision of the howling detector shown in FIG. 10, the probability of erroneous detection is lowered even if a signal having a peak on the frequency axis in a relatively short period, such as the sound of footsteps, is applied as the input signal, as does the howling suppressor of the fifth embodiment.

In addition, the amount of operation is less than that of the howling suppressor of the fifth embodiment and the howling can be detected faster.

Figure 12:
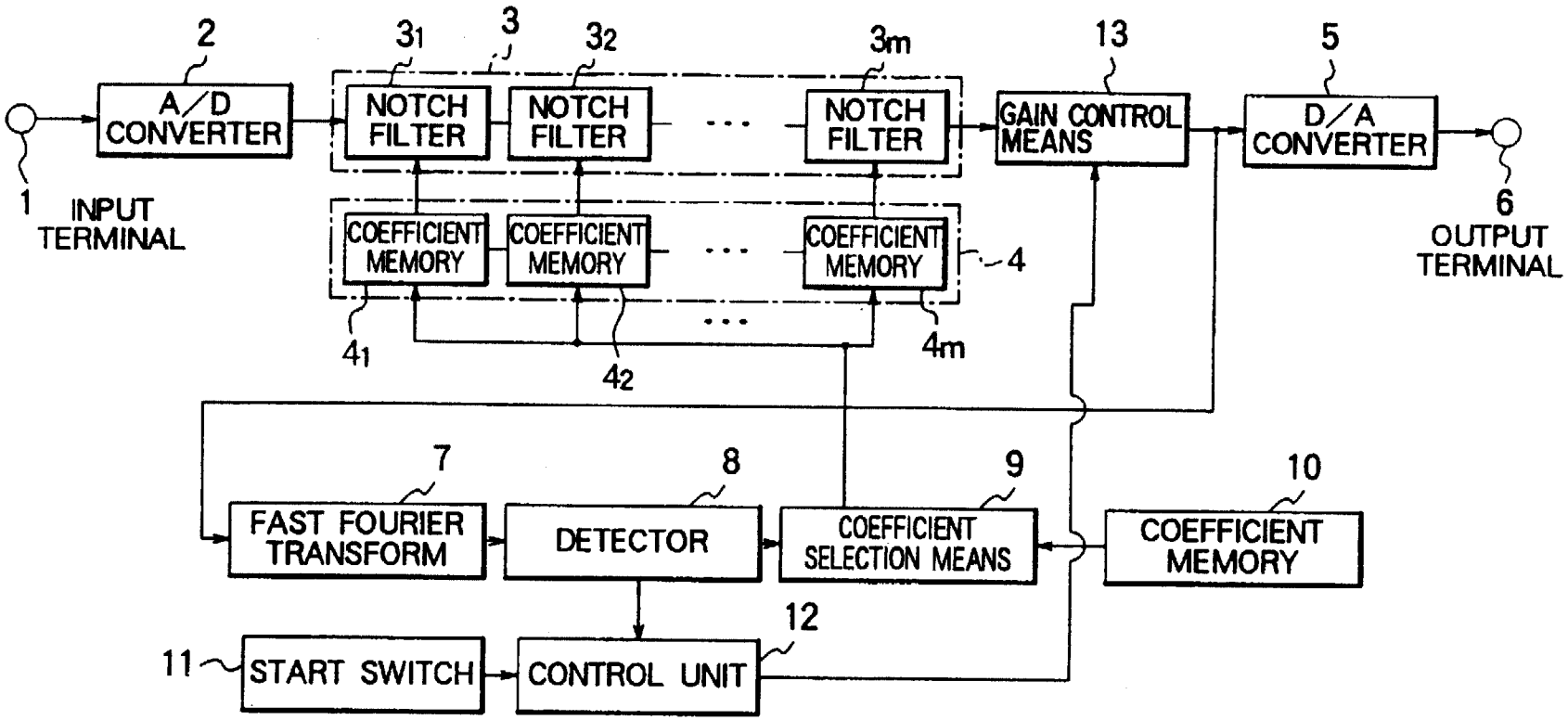
FIG. 12 shows a block diagram of a howling suppressor in a seventh embodiment of the present invention.

FIG. 12 shows a block diagram of a howling suppressor in a seventh embodiment of the present invention. The howling suppressor of the present embodiment differs from the howling suppressor of the first embodiment in the following points.

(1) Gain control means 13 for controlling the gain of the output signal of the group of notch filters 3 is provided between the group of notch filters 3 and the D/A converter 5, and the output of the gain control means 13 is connected to the fast Fourier transform unit 7.

(2) A control unit 12 for controlling the gain of the gain control means 13 is connected to the output of the detector 8.

(3) A start switch 11 is connected to the control unit 12.

Figure 13:
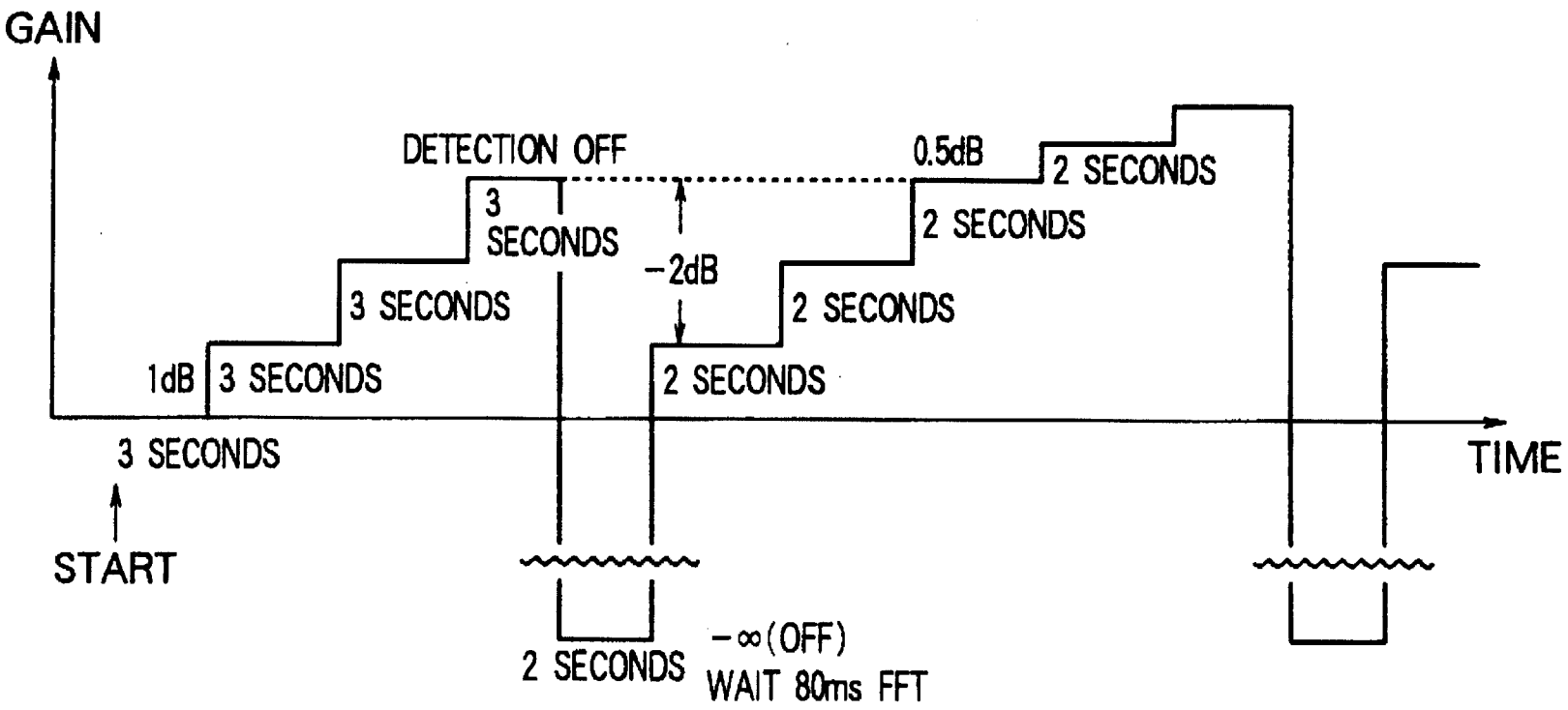
FIG. 13 shows a characteristic chart showing the operation of a control unit in the seventh embodiment of the present invention.

The operation of the control unit 12 in the seventh embodiment will now explained. When the start switch 11 is depressed, the control unit 12 clears the notch filters $3_0$~$3_m$ so that they exhibit flat frequency characteristics. Then, it controls the gain of the gain control means 13 in the sequence shown in FIG. 13. Namely, until the first howling detection, the gain of the gain control means 13 is incremented by 1 dB at a 3-second interval. If howling is detected by the detector 8, which is coupled to the control unit 12, the gain of the gain control means 13 is temporarily set to $-\infty$ (OFF) for two seconds and then it is returned to a gain which is 2 dB smaller than the gain when howling was detected. Thereafter, gain of the gain control means 13 is incremented by 0.5 dB at a 2-second interval. This operation is repeated each time the howling is detected. When the setting of the frequencies of all notch filters $3_1$~$3_m$ is completed, the gain of the gain control means 13 is reset to 0 dB.

In this sequence, the howling can be automatically suppressed without rapid growth of the howling.

In the howling suppressor of the seventh embodiment, the control unit 12 and the gain control means 13 are provided as a time-serially varying sound level control means to control the gain between the input and the output. Thus, the occurrence of howling can be managed and the rapid growth of howling is prevented by a link between the occurrence of howling and the detection of the howling, so that howling can be automatically suppressed and simple operation can be attained.

Figure 14:
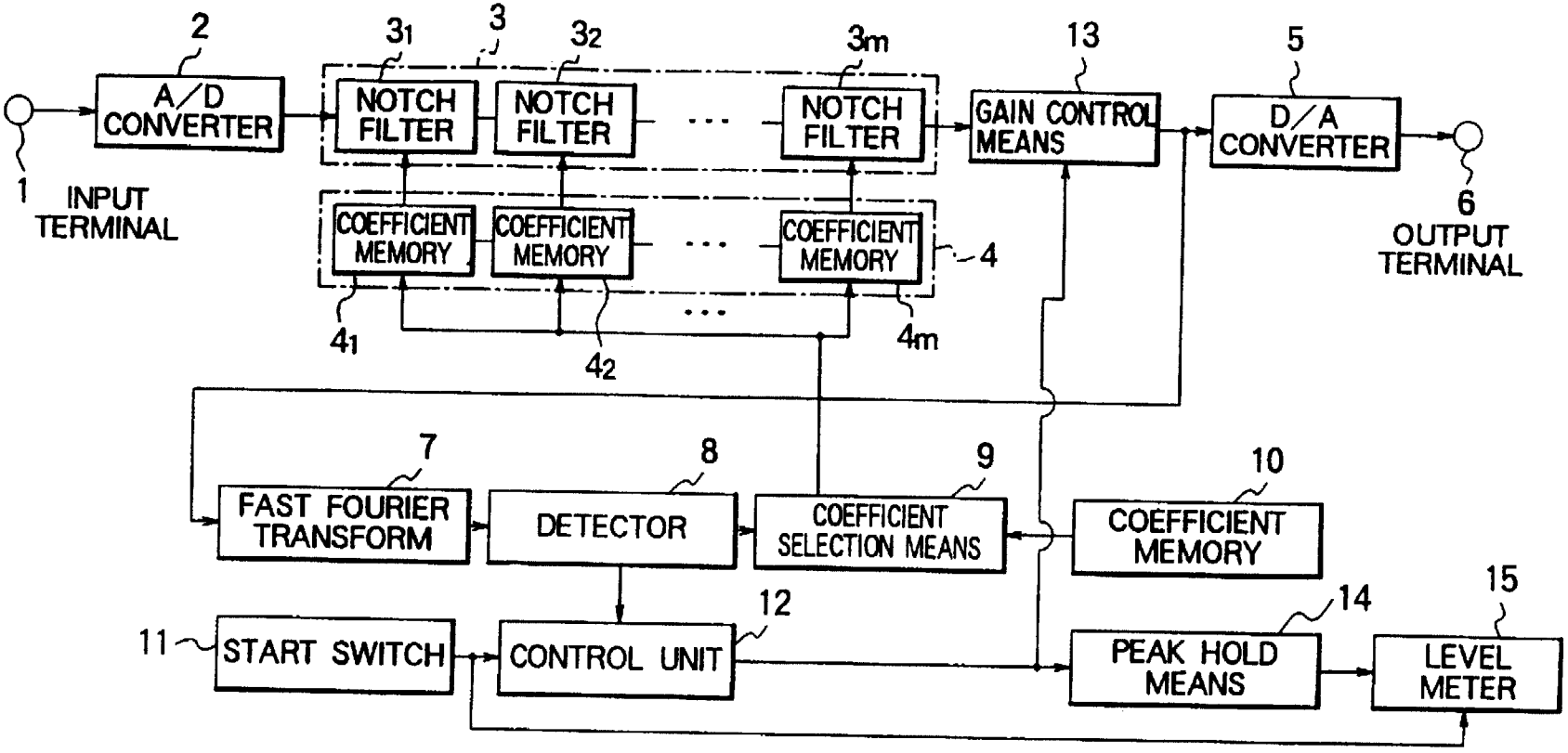
FIG. 14 shows a block diagram of a howling suppressor in an eighth embodiment of the present invention.

FIG. 14 shows a block diagram of a howling suppressor in an eighth embodiment of the present invention. The howling suppressor of the present embodiment differs from the howling suppressor of the seventh embodiment shown in FIG. 12 in that it is provided with a peak hold means 14 connected to the output of the control unit 12, which is connected to the gain control means 13 and a level meter 15 connected to the output of the peak hold means 14.

Figure 15:
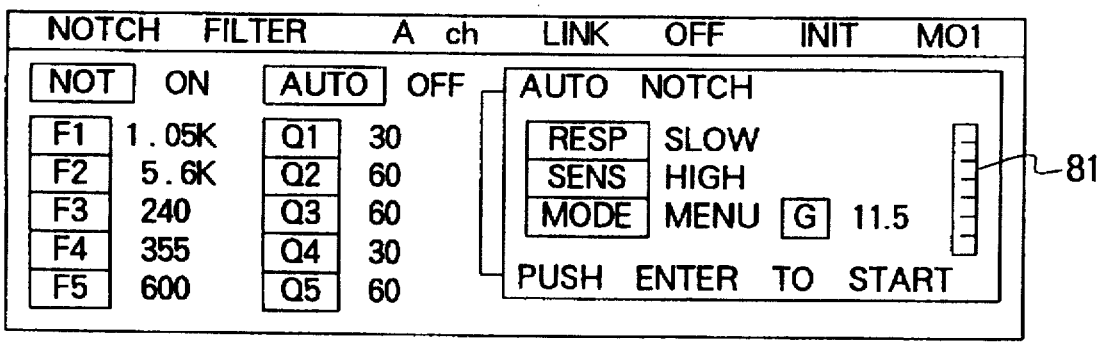
FIG. 15 shows a display screen of a display of a howling suppressor in the eighth embodiment of the present invention.

In the howling suppressor of the present embodiment, the control unit 12 operates in the same manner as that described in the seventh embodiment and the peak hold means 14 holds the peak of the gain and the level meter 15 displays the maximum gain during the howling detection period. FIG. 15 shows a display device such as a liquid crystal display in which the maximum gain inputted to the level meter 15 is displayed in a bar graph display area 81 together with the gain value "G".

When the maximum of the gain is displayed on the level meter 15, the energy of the input signal attenuated by the notch filters substantially matches to the margin increment of the howling because it may be neglected when the band width of the notch filters is sufficiently narrow.

In the eighth embodiment, the peak of the gain imparted to the sound level control means of the seventh embodiment is displayed so that the howling suppression effect, that is, the increment of the acoustic gain by the suppression of the howling, can be rapidly grasped.

Figure 16:
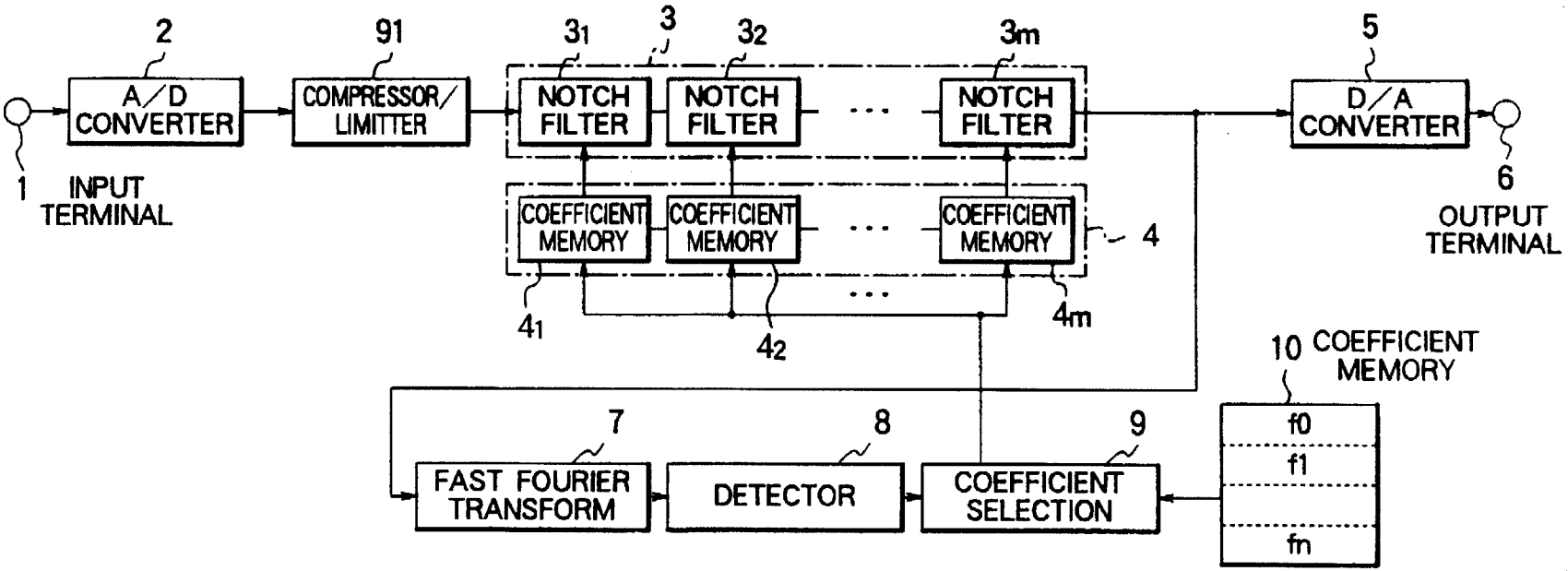
FIG. 16 shows a block diagram of a howling suppressor in a ninth embodiment of the present invention.

FIG. 16 shows a block diagram of a howling suppressor in a ninth embodiment of the present invention. The howling suppressor of the present embodiment differs from the howling suppressor of the first embodiment shown in FIG. 2 in that a compressor/limiter 91 for limiting the amplitude is connected preceding to the group of notch filters 3.

In the howling suppressor of the present embodiment, even if the detection of howling fails and the howling rapidly grows, the amplitude is limited by the compressor/limiter 91 so that damage to the equipment such as a speaker connected to the output of the present apparatus is avoided. Further, since the compressor/limiter 91 limits the amplitude without increasing the distortion, erroneous detection of howling due to harmonics distortion can be avoided.

The compressor/limiter 91 may be connected succeeding to the group of notch filters 3 instead of preceding thereto to attain the same effect.

Other embodiments of the howling suppressor and detector of the present invention are mentioned below:

(1) A multi-channel howling suppressor having a plurality of input/output terminals to individually suppress howling, (2) A multi-channel howling suppressor having a plurality of input/output terminals and actuating notch filters of respective channels substantially simultaneously to set the same setting.

(3) A howling suppressor having a so-called parametric equalizer in addition to the notch filters inserted between the input and the output to control howling as well as the sound quality.

(4) A howling suppressor having a ⅓ octave resolution graphic equalizer in addition to the notch filters inserted between the input and the output to control howling as well as the sound quality.

(5) A howling suppressor having a delay circuit in addition to the notch filters inserted between the input and the output to control howling as well as delay the reproduced signal from the speaker.

(6) A howling suppressor of the first embodiment having a spectrum analyzer comprising a plurality of band pass filters connected thereto to monitor the spectrums of the input signal and the output signal.

(7) A howling suppressor of the first embodiment for displaying the characteristics of the notch filters on a liquid crystal display to visualize the characteristics of the notch filters.

(8) A howling suppressor for visualizing the characteristics of the notch filters on a display screen of an external control equipment such as a computer by a communication interface.

(9) A howling suppressor capable of automatically setting the notch filters as in the seventh embodiment and capable of manual setting of the center frequencies of the notch filters and the gain setting means by a jog dial or a rotary encoder.

(10) A howling suppressor of the first embodiment having a notch filter having a center frequency equal to an integer multiple of the power supply frequency for eliminating power supply noise included in the input signal to reduce the possibility of erroneous detection.

(11) A howling suppressor of the first embodiment having a diode connected between the output terminal and ground to limit the amplitude during the growth of howling to prevent damage to the succeeding stages of the equipment. The cathode of the diode is connected to the output terminal and the anode of the diode is connected to the ground.

(12) A howling suppressor of any of the embodiments connected to an input or an output of a convolute device or reverberation device for controlling a sound field to eliminate coloration inherent to the convolute device or the reverberation device.

(13) A howling suppressor of any of the embodiments having a microphone amplifier connected to the input thereof for permitting direct connection of a microphone.

(14) A howling suppressor of any of the embodiments having a power amplifier connected to the output thereof for permitting direct connection of a speaker.

As seen from the first embodiment of the present invention, since the signal to detect howling is derived from the output of the group of notch filters which eliminate the howling, even if an input signal having a hum component having a peak at a predetermined frequency is applied, the hum can be eliminated by the group of notch filters. As a result, erroneous detection of howling due to the hum is unlikely to occur.

As seen from the second embodiment of the present invention, since the weighted difference of the mean value (or the sum) and the peak value of the analysis results is used to detect the howling, erroneous detection is unlikely to occur even if the background noise level changes.

As seen from the third embodiment of the present invention, when the weighted difference between the maximum value of the analysis results and the mean value (or the sum) of any plurality of ones of the analysis results exceeds the preset value, the occurrence of howling is detected. Accordingly, the amount of operation is less than that of the second aspect and the howling can be detected faster.

As seen from the fourth embodiment of the present invention, when the mean value (or the sum) of the analysis results is calculated, a plurality of the largest ones of the analysis results are eliminated. Accordingly, howling may be detected while it has not fully grown and remains at a low level, and the time required to detect the howling is shortened.

As seen from the fifth embodiment of the present invention, when a peak frequency corresponding to the howling frequency continuously appears a plurality of times, the occurrence of howling is detected. Accordingly, a signal having a frequency peak in a relatively short period, such as the sound of footsteps, is unlikely to be detected as howling, and a signal with a varying pitch (peak frequency), such as the sound of a whistle or a musical instrument, is also unlikely to be detected as howling, and hence erroneous detection is unlikely to occur.

As seen from the sixth embodiment of the present invention, when a peak frequency corresponding to the howling frequency continuously appears a plurality of times, the occurrence of howling is detected. Accordingly, the amount of operation is less than that of the fifth aspect and the howling can be detected faster.

As seen from the seventh embodiment of the present invention, a time-serially varied sound level control means is provided to control the gain between the input and the output. Accordingly, control of the occurrence of howling can be managed and the howling can be automatically suppressed by the link of the occurrence of the howling and the detection of the howling, without rapid growth of the howling, and simple operation is attained.

As seen from the eighth embodiment of the present invention, the peak of the gain imparted by the sound level control means is displayed. Accordingly, a howling suppression effect, that is, the rise increment of the acoustic gain by the howling suppression, can be rapidly grasped.

As seen from the ninth embodiment of the present invention, a compressor/limiter for limiting the amplitude is provided in the preceding or succeeding stage of the notch filter. Accordingly, even if the detection of howling fails and the howling grows rapidly, the amplitude is limited by the compressor/limiter to avoid damaging equipment such as the speaker connected to the output of the present apparatus. Further, since the compressor/limiter limits the amplitude without increasing distortion, erroneous detection by the howling detector due to harmonics distortion can be avoided.

What is claimed is:

1. A feedback detector and suppressor, comprising:

an A/D converter for converting an analog signal to a digital signal;

a plurality of cascade-connected notch filters coupled to an output of said A/D converter, the cascade-connected notch filters including a last notch filter;

gain control means, coupled to an output of the last notch filter, for controlling a gain of an output signal of said last notch filter;

a D/A converter, coupled to an output of said gain control means, for converting a digital output signal of said gain control means to an analog output signal;

frequency analysis means, coupled to the output of said gain control means, for analyzing a frequency characteristic of said digital output signal of said gain control means;

detection means, coupled to an output of said frequency analysis means, for detecting howling in the output signal of said last notch filter and producing peak frequency values for center frequencies of said notch filters based on analysis results by said frequency analysis means; and control means, coupled to said detection mans, for controlling said gain control means to time-serially vary the gain of said output signal of said last notch filter when said detection means detects howling.

2. A feedback and suppressor according to claim 1, further comprising a compresser/limiter, preceding said plurality of notch filters, for limiting the amplitude of an output signal to said compressor/limiter.

3. A feedback detector and suppressor according to claim 1, further comprising a compressor/limiter, succeeding said plurality of notch filters, for limiting he amplitude of an input signal to said compressor/limiter.

4. A feedback detector and suppressor, comprising:

an A/D converter for converting an analog signal to a digital signal;

gain control means, coupled to an output of said A/D converter, for controlling the gain of an output signal of said A/D converter;

a plurality of cascade-connected notch filters coupled to an output of said gain control means, the cascade-connected notch filters including a last notch filter;

a D/A converter, coupled to an output of the last notch filter, for converting a digital output signal of said last notch filter to an analog output signal;

frequency analysis means, coupled to the output of said last notch filter, for analyzing a frequency characteristic of said digital output signal of said last notch filter;

detection means, coupled to an output of said frequency analysis means, for detecting howling in the output signal of said last notch filter and producing peak frequency values for center frequencies of said notch filters based on analysis results by said frequency analysis means; and control means, coupled to said detection means, for controlling said gain control means to time-serially vary the gain of said output signal of said A/D converter when said detection means detects howling.

5. A feedback and suppressor according to claim 4, further comprising a compressor/limiter, preceding said plurality of notch filters, for limiting the amplitude of an input signal to said compressor/limiter.

6. A feedback detector and suppressor according to claim 4, further comprising a compressor/limiter, succeeding said plurality of filters, for limiting the amplitude of an input signal to said compressor/limiter.

7. A feedback detector and suppressor, comprising:

a plurality of circuits connected in series along a signal path from an input terminal to an output terminal, the circuits including a notch filter and a gain control circuit, frequency analysis means, coupled to the signal path, for analyzing a frequency characteristic of a signal carried by the signal path;

detection means, coupled to the frequency analysis means, for detecting howling in the signal carried by the signal path and for producing a peak frequency value for a center frequency of the notch filter based on a signal from the frequency analysis means; and control means, coupled to the detection means, for gradually increasing the gain of the gain control means until howling is detected by the detection means and then abruptly reducing the gain of the gain control means.

8. A feedback detector and suppressor according to claim 7, wherein the gain control circuit has an input terminal, an output terminal, and a gain control terminal, wherein the notch filter has an output terminal that is connected to the input terminal of the gain control circuit, wherein the output terminal of the gain control terminal is connected to the frequency analysis means, and wherein the control terminal of the gain control circuit is connected to the control means.

9. A feedback detector and suppressor according to claim 7, wherein the plurality of circuits connected in series further includes at least one additional notch filter, and wherein the detection means further includes means for producing a peak frequency value for a center frequency of the at least one additional notch filter.

10. A feedback detector and suppressor according to claim 9, wherein the control means further includes means for gradually increasing the gain of the gain control means again, after howling has been detected and the gain has been abruptly reduced, until howling has been detected by the detection means again, and then abruptly reducing the gain of the gain control means again.

11. A feedback detection and suppressor according to claim 10, wherein the plurality of circuits connected in series further includes a compressor/limiter to limit the amplitude of the signal carried by the signal path.

12. A feedback detector and suppressor according to claim 11, wherein the plurality of circuits connected in series includes an A/D converter that is connected to the input terminal and a D/A converter that is connected to the output terminal, and wherein the notch filter, the at least one additional notch filter, the gain control circuit, and the compressor/limiter are connected in series between the A/D converter and the D/A converter.

* * * * *